US010800627B2

(12) United States Patent
Perini

(10) Patent No.: US 10,800,627 B2
(45) **Date of Patent: *Oct. 13, 2020**

(54) PLANT AND PROCESS FOR THE PRODUCTION OF PAPER ROLLS

(71) Applicant: FUTURA S.P.A., Capannori Fraz. Guamo (IT)

(72) Inventor: Fabio Perini, Viareggio (IT)

(73) Assignee: FUTURA S.P.A., Capannori (LU) Fraz. Guamo (IT)

( * ) Notice: Subject to any disclaimer, the term of this patent is extended or adjusted under 35 U.S.C. 154(b) by 222 days.

This patent is subject to a terminal disclaimer.

(21) Appl. No.: 15/896,376

(22) Filed: Feb. 14, 2018

(65) Prior Publication Data

US 2018/0170700 A1 Jun. 21, 2018

Related U.S. Application Data

(63) Continuation of application No. 15/537,641, filed as application No. PCT/IT2015/000276 on Nov. 11, 2015.

(30) Foreign Application Priority Data

Dec. 20, 2014 (IT) ..... FI2014A0299

(51) Int. Cl.
*B65H 19/22* (2006.01)

(52) U.S. Cl.
CPC ..... *B65H 19/2269* (2013.01); *B65H 2301/41704* (2013.01)

(58) Field of Classification Search
CPC ..... B65H 19/2269; B65H 2301/41704
See application file for complete search history.

(56) References Cited

U.S. PATENT DOCUMENTS 3,926,299 A * 12/1975 Bradley ..... B65G 1/0442 198/347.3
5,344,091 A * 9/1994 Molison ..... B26D 1/385 242/527.1

* cited by examiner

*Primary Examiner* — William E Dondero
(74) *Attorney, Agent, or Firm* — McGlew and Tuttle, P.C.

(57) ABSTRACT

Process for the production of paper rolls, including a step of producing logs (L) of paper material by winding a predetermined amount of paper web (W) about a respective longitudinal axis, a step of transverse cutting of the logs (L) to obtain rolls (RO) of predetermined length, and an intermediate step of transporting the logs (L) from a rewinder (R) that produces the logs (L) toward a cutting-off machine (CM) that cuts them transversely. The intermediate transporting step involves the handling of the logs (L) along a path comprising a lateral deviation, so that, as they advance, the logs (L) are subjected to the lateral deviation.

20 Claims, 7 Drawing Sheets

PLANT AND PROCESS FOR THE PRODUCTION OF PAPER ROLLS

CROSS REFERENCE TO RELATED APPLICATIONS

This application is a continuation under 37 CFR 1.53(b) of pending prior application Ser. No. 15/537,641 filed Jun. 19, 2017, which claims the benefit (35 U.S.C. § 120 and 365(c)) of International Application PCT/IT2015/000276 filed Nov. 11, 2015 and claims the benefit of priority under 35 U.S.C. § 119 of Italian Patent Application FI2014A000299 filed Dec. 20, 2014, the entire contents of each application are incorporated herein by reference.

DESCRIPTION

The present invention relates to a plant and a process for the production of paper rolls.

It is known that the production of paper logs involves the feeding of a continuous paper web along a predefined path. At a preset point of said path, a transverse discontinuous cut is made on the paper to subdivide it into portions or sheets each having a predetermined length. This known technique involves the use of tubular cardboard elements, commonly said cores, on whose surface is distributed a predetermined amount of glue to allow the gluing of the first sheet of the log to be formed. This technique also provides for the use of winder rollers, positioned and acting in a logs forming station, which cause the rotation of the core on which the paper web is wound. The formation of a log is completed after that a predetermined amount of paper is wound on the core. At this point, another log is formed. At the end of the log formation process it is necessary to glue the last sheet of each log on the underlying one in order to avoid the spontaneous unwinding of the paper web. Cutting-off machines are subsequently used to subdivide each log into several rolls of smaller length to be packed.

Generally the production of paper rolls according to the scheme described above require that the tube-forming machines that produce the cores and the cutting-off machines are oriented transversely with respect to the path followed by the paper. This implies, however, the need for very large spaces and, therefore, high financial investments are required for the acquisition of the necessary spaces. Typically, a plant of the type described above, in fact occupies a very wide surface.

The main purpose of the present invention is to propose a plant and a process for the production of paper rolls allowing a remarkable reduction of the space required for the installation of the machines, without compromising the efficiency of the process or the quality of the finished product.

This result is achieved in accordance with the present invention, by providing a system a plant and a process having the features indicated in the independent claims. Other features of the present invention are the subject of the dependent claims.

Among the main advantages offered by the present invention there is the fact that, by reducing the space required for the installation of the machines, less economic resources are required, which positively reflects also on the cost of the finished product. In addition, since the production cycle is changed only with reference to some operational phases, the plant can be managed also by personnel that normally operates the traditional systems. A further advantage is the relatively low cost of the modifications required to implement the present invention with respect to conventional plants and processes. Furthermore, in case of a plant comprising two or more production lines, given the lesser surface occupied by each line, the lines can be arranged closer to each other and the plant occupies a less extended area and therefore offers the possibility of using less operators, in particular a smaller number of plant managers or supervisors, compared to a conventional plant having the same number of production lines.

These and other advantages and features of the present invention will be best understood by anyone skilled in the art thanks to the following description and to the attached drawings, provided by way of example but not to be considered in a limitative sense, wherein.

Figure 3:
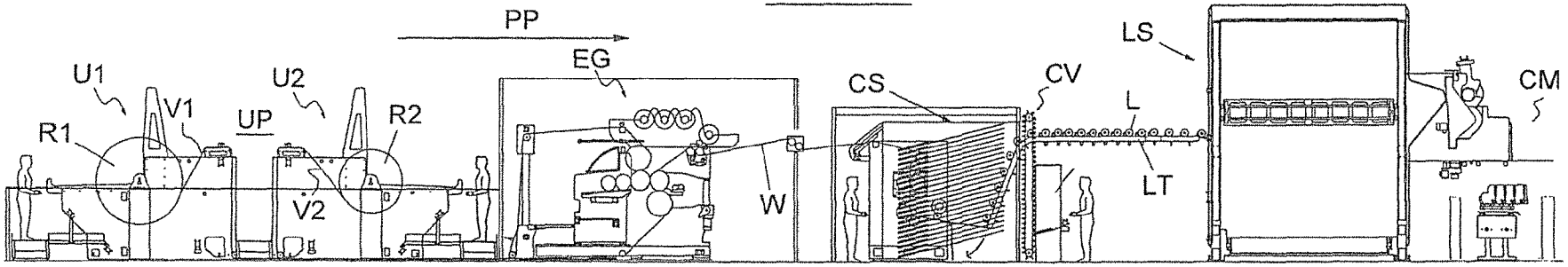
FIG. 3 is a view similar to that of FIG. 2 but it refers to a further embodiment of the plant.
Figure 8:
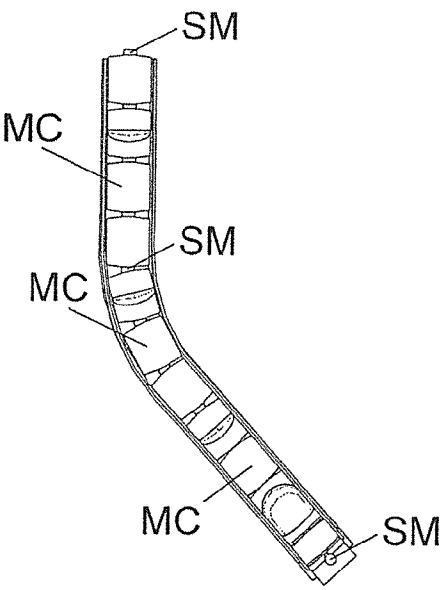
Figure 7:
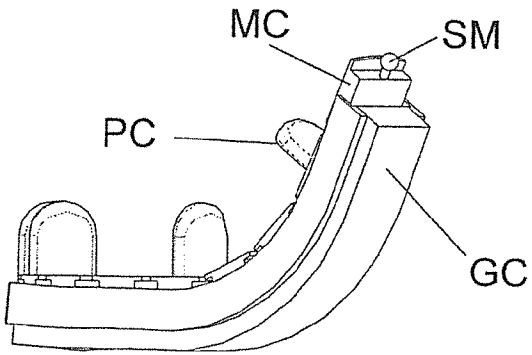
Figure 10:
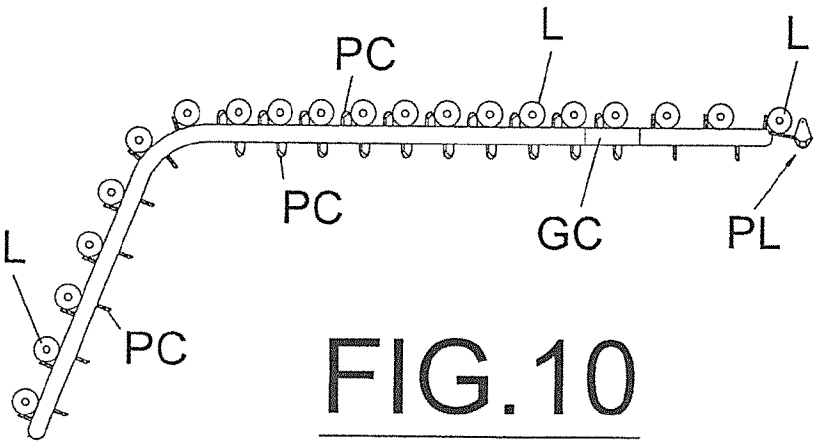
Figure 9:
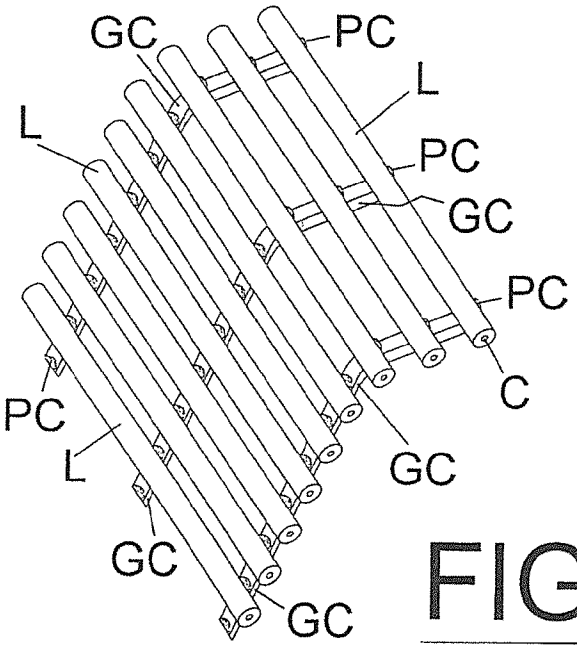

FIGS. 7-9 schematically represent a part of the logs transport unit (LT);

FIG. 10 is an enlarged detail of FIG. 3.

Reduced to its basic structure and with reference to the attached drawings, a plant for the production of paper rolls (for example, rolls of toilet paper or rolls of kitchen paper) in accordance with the present invention typically comprises:

- a paper unwinding station (UP) with one or more unwinders (in the example, the unwinders are two in number and are indicated by references "U1" and "U2") that support a corresponding number of paper reels (R1, R2) from each of which a paper ply (V1, V2) unwounds;
- a unit (EG) for coupling of the paper plies coming from the unwinding station (UP), with an embossing and gluing unit in which said plies can be be embossed and joined together by gluing to form a two-plies paper web (W);
- a rewinder (R) which on side receives the paper web (W) and on another side receives the tubular cores on which the paper web is wound to form the logs (L);
- a tube-forming machine (T) that produces the tubular cores;
- a first accumulator (CS), which receives and accumulates the cores produced by the tube-forming machine (T) and feeds the rewinder (R);
- a second accumulator (LS) which receives the logs produced by the rewinder (R);
- a transport unit (LT) which receives the logs outgoing from the rewinder (R) and transports them to the second accumulator (LS);
- a cutting-off machine (CM) which receives the logs coming from the second accumulator (LS) and subdivides them into rolls of lesser length.

The unwinders (U1, U2) allow the unwinding of the plies (V1, V2) from the reels (B1, B2). Said plies are embossed and glued in the station (EG) that produces the web (W) formed by the embossed and glued plies. The web feeds the rewinder (R) that provides for winding a predetermined amount thereof on each core (C) coming from the first accumulator (CS) and produced by the tube-forming machine (T). The core (C) allows the winding of the web (W) around an axis defined by the longitudinal axis of the same core (C). The logs thus produced in the rewinder (R) reach the conveyor (LT) which conveys them up to the second accumulator (LS). The latter feeds the cutting-off machine (CM) that cuts the logs to obtain rolls of the desired length.

The tube-forming machine (T) and the cutting-off machine (CM) are oriented transversely to the path (PP) followed by the paper web. Therefore, the cores produced by the tube-forming machine (T) and exiting from the latter move along a direction substantially perpendicular to said path (PP) and the rolls produced by the cutting-off machine (CM) go out from the latter also in a direction substantially perpendicular to said path (PP).

The first accumulator (CS) receives the cores produced by the tube-forming machine (T) by means of a vertical conveyor (VC).

The unwinders (U1, U2), the embossing and sizing unit, the rewinder, the accumulator for the cores, the accumulator for the logs, the tube-forming machine, the means for transferring the cores from the tube-forming machine to the first accumulator, the means for transferring the logs from the second accumulator to the cutting-off machine, and the cutting-off machine can be of the type normally used for the production of paper rolls. EP0454633 and U.S. Pat. No. 6,715,709 disclose rewinders, the entire contents of EP0454633 and U.S. Pat. No. 671,570 are herein incorporated by reference; WO2011/089634 discloses an accumulator for tubular cardboard cores, the entire contents of WO2011/089634 are herein incorporated by reference; WO2004/014641 discloses a tube-forming machine, the entire contents of WO2004/014641 are herein incorporated by reference; U.S. Pat. No. 3,926,299 and U.S. Pat. No. 3,762,582 disclose devices for handling and storage of paper logs, the entire contents of U.S. Pat. No. 3,926,299 and U.S. Pat. No. 3,762,582 are herein incorporated by reference.

Figure 2:
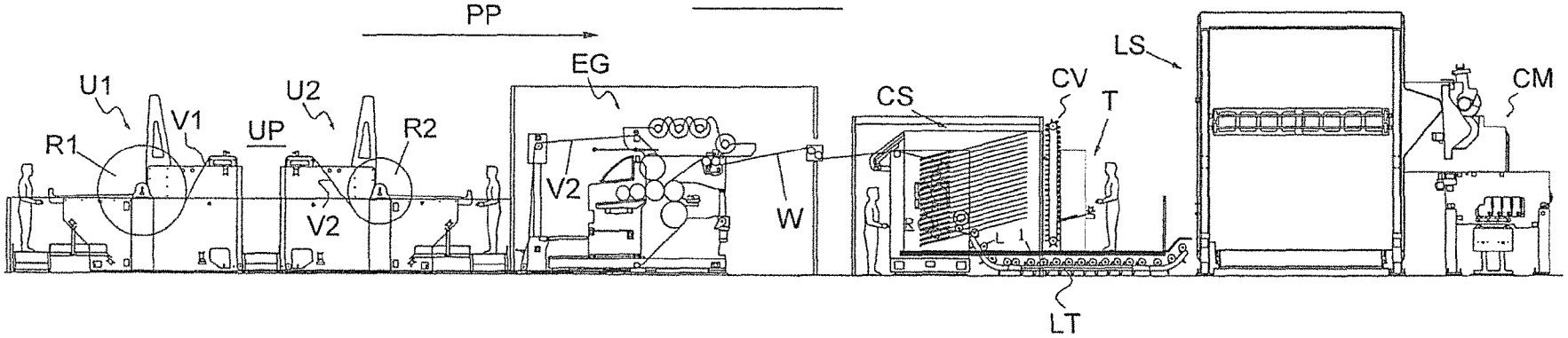
FIG. 2 is a schematic side view of the plant shown in FIG. 1.

According to the example shown in FIG. 2, the tube-forming machine (T) is placed downstream of the rewinding machine (R) and is positioned on a platform (1) under which is arranged the transport unit for the logs (LT). The cutting-off machine (CM) is placed downstream of the second accumulator (LS). Since the transport unit (LT) imposes a lateral deviation to the logs while they move towards the second accumulator (LS), the cutting-off machine (CM) may be positioned within the outline "A" of the production line, that is, within line formed by the unwinders, the embossing-sizing unit, the rewinder, the first accumulator and the tube-forming machine. In the example, the transport unit (LT) determines a deviation (LD) of the logs to the left while the logs advance along the path comprised between the rewinder (R) and the second accumulator (LS). Thanks to the lateral deviation imposed to the logs that move towards the second accumulator (LS), the cutting-off machine (CM) can be arranged as described above and this reduces the overall width of the production line compared to the traditional plants that provide for a straight advancement of the logs between the rewinder and the accumulator for the logs. When seen from above, according to the example shown in the drawings, the transport unit for the logs (LT) is "S"-shaped. It is understood that, if required, when seen from above the transport unit of the logs (LT) can comprise a first rectilinear section, a second "S"-shaped section, and a third straight section. Otherwise, when seen from above the transport unit for the logs (LT) may include a "S"-shaped section preceded or followed by a straight section. Again, when seen from above the transport unit for the logs is rectilinear, oriented with a predetermined angle with respect to the above-mentioned path (PP). In any case, the output section of the transport unit for the logs (LT) is laterally displaced with respect to the centerline of the rewinder of a predetermined amount "B".

It is observed that with the current production requirements, characterized by high operating speeds (production rate of at least 60 logs per minute), the lateral displacement of the logs (not combined with the advancement) would require a conveyor surface with an extremely high friction coefficient which, however, implies damages to the surface of the logs. In the past, such a solution has been adopted but for lower production rates (about 20 logs per minute). The combination of the advancement and the lateral displacement of the logs implies a lower speed lateral component without imposing any reduction of the operating speeds.

Figure 1:
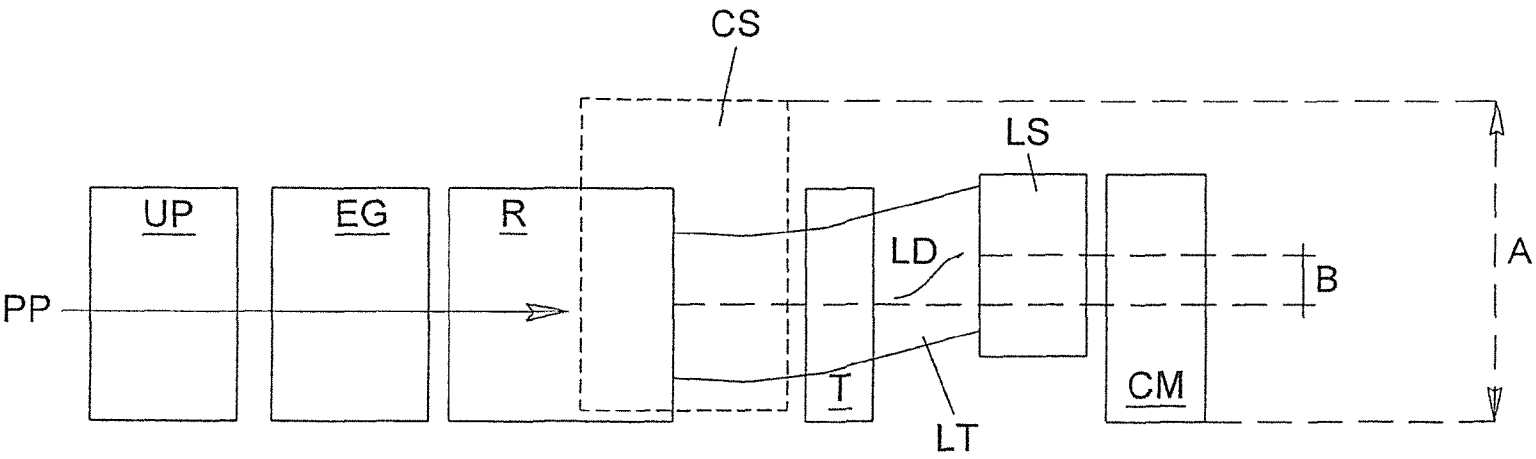
FIG. 1 is a schematic top view of a plant in accordance with the present invention.

Referring to the diagram of FIG. 1, in an experimental facility built by the applicant's the dimension "A" was about 12.00 (twelve) meters and dimension "B" was 2.265 (two-point-two-hundred-sixty-five) meters. The experimental plant was intended to produce logs having a maximum size of 2850 mm.

With reference to the example shown in FIG. 3, the machines arrangement (in particular, the arrangement of the unwinders, the embossing-sizing unit, the rewinder, the accumulators and the cutting-off machine) is the same as in the previous case but the tube-forming machine (T) is on the same base of the other machines and the transport unit (LT) has an ascending section for passing over the tube-forming machine (T). Also in this case, the transport unit (LT) obliges the logs to deviate sideways while advancing towards the second accumulator (LS).

Figure 4:
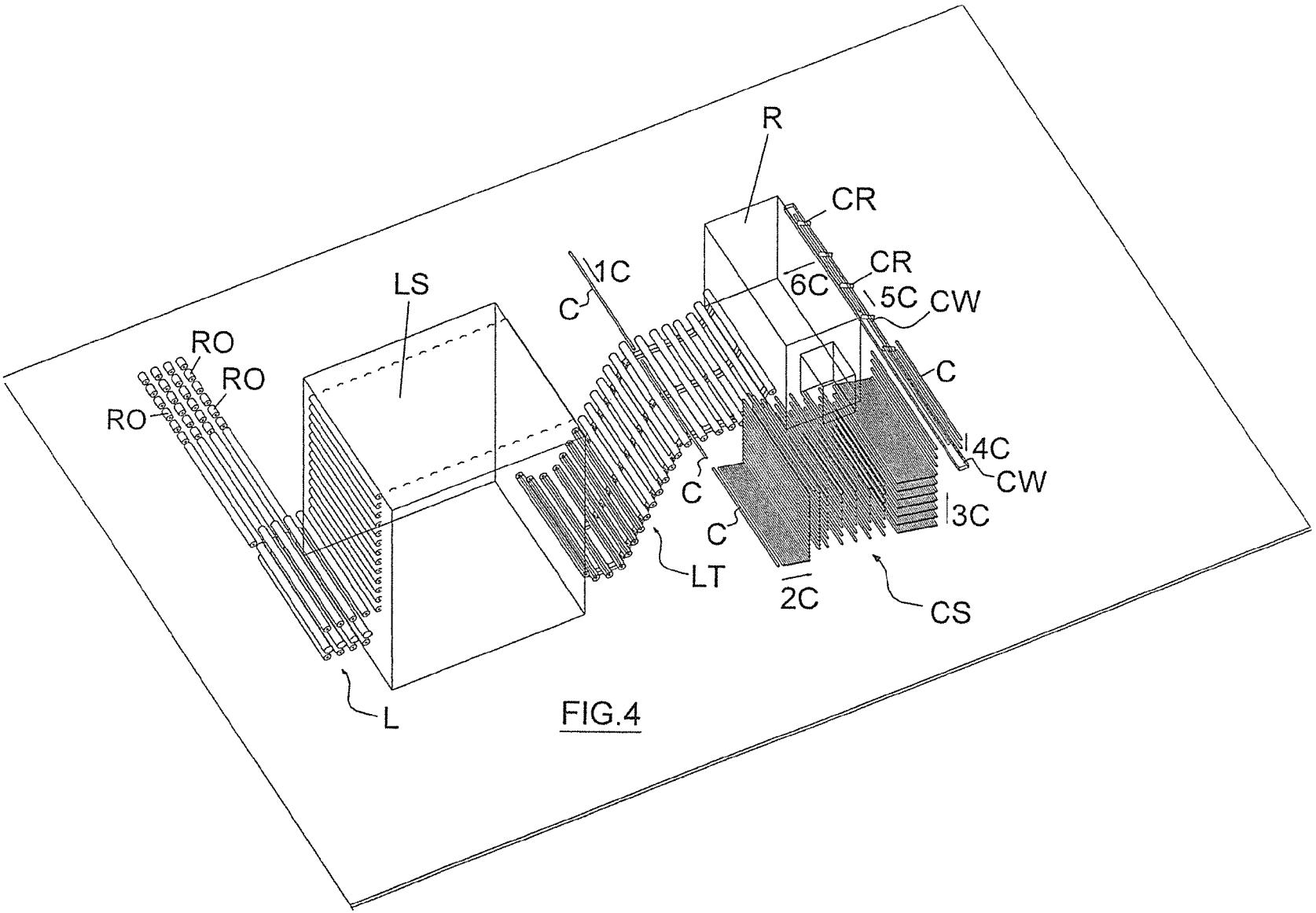
FIG. 4 shows the path of the cores and the logs in the area between the rewinder and the tube forming machine.
Figure 6:
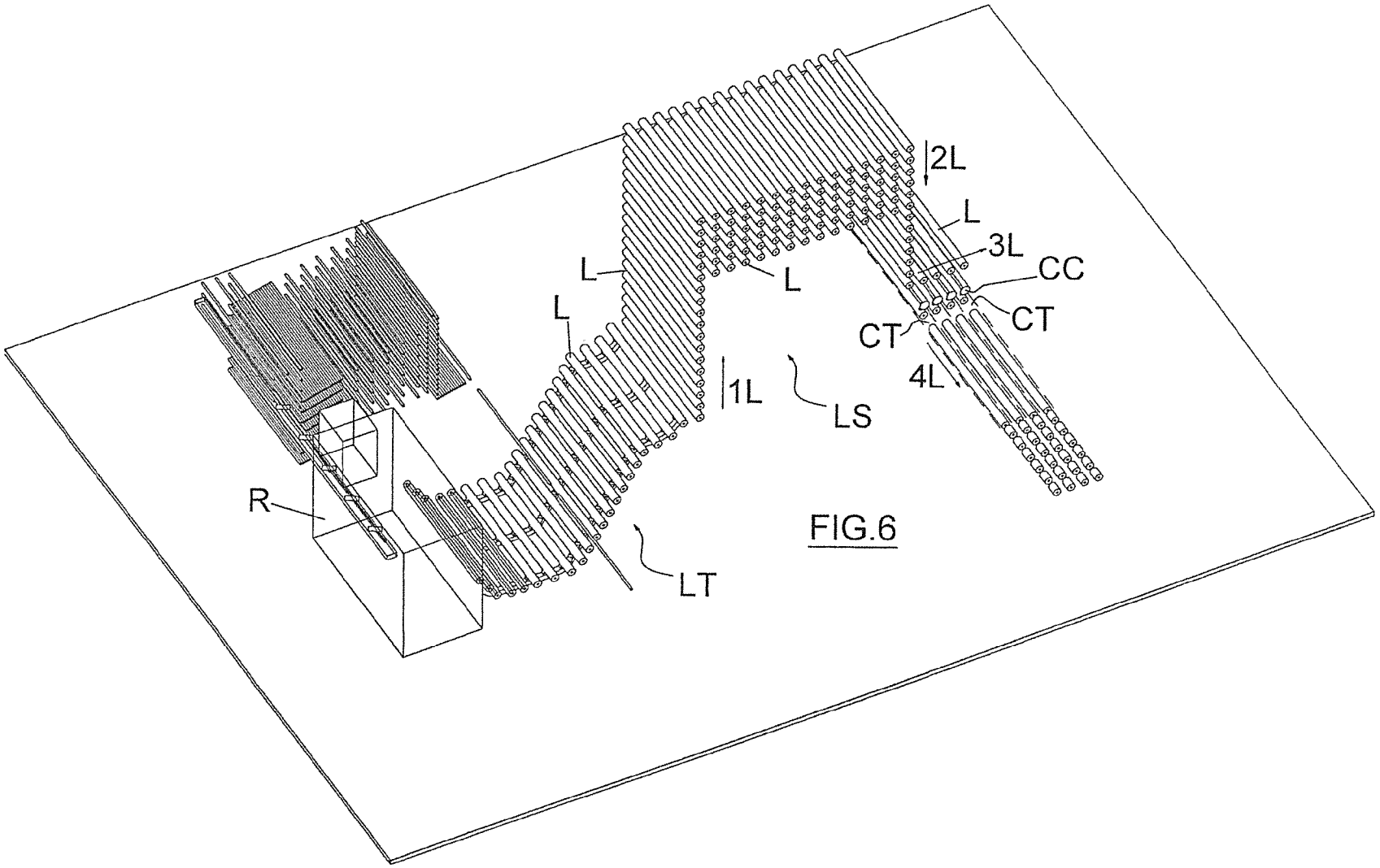
FIG. 6 shows the path of the logs and the cut rolls in the area between the accumulator for the logs and the cutting-off machine.

In FIG. 4 and FIG. 6, where the constructive details of the individual machines (in particular, the constructive details of the rewinder and the first and second accumulator) are not illustrated, it is shown the path of the cores (C) and the logs (L) in the area between the rewinder (R) and the tube-forming machine (T).

Figure 5:
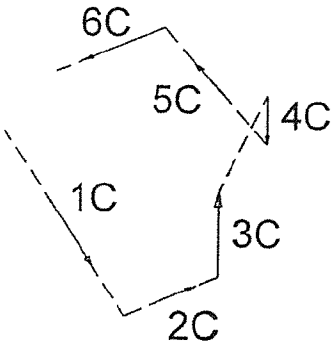
FIG. 5 is a diagram showing the movements of the cores in the area between the rewinder and the tube forming machine.

In particular, FIG. 4 shows: a first horizontal translation (1C) of the cores leaving the tube-forming machine above the transport unit (LT); a second horizontal translation (2C) of the cores (C) when entering the first accumulator (CS), the second translation (2C) being orthogonal to the first (1C); a third ascending vertical movement (3C) of cores (C) in a stage prior to their exit from the first accumulator (CS); a fourth descending vertical movement (4C) of cores (C) when leaving the first accumulator; a fifth horizontal translation (5C) of cores (C) in the direction opposite to the first (1C); a sixth horizontal translation (6C) of cores (C) when they enter the rewinder (R); the transport unit (LT) that determines the advancement and the simultaneous lateral deviation of the logs (L). FIG. 5 shows the overall path followed by cores (C).

The translation (1C) is determined by the tube forming machine (T) that, while producing the cores (C), advances them, that is, forces them to move as shown in FIG. 4 (arrow "1C"). The translation (2C) is determined by the inlet section of the first accumulator (CS) which is normally provided with an input section that picks up the cores from the tube-forming machine (T). Within the first accumulator (CS), the cores are supported by shaped bars that move along a trajectory consisting of a succession of vertical and horizontal sections. The translation (3C) is the last run of the cores (C) within the first accumulator (CS). The translation (4C) takes place at the exit of the cores (C) from the first accumulator (CS) and ends with the deposition of the same cores on a belt conveyor (CW) that receives and transports the cores determining the fifth translation (5C). The sixth translation (6C) is determined by the fact that the conveyor (CW) is provided, in a per se known manner, of inclined cylindrical rollers (CR) that determine the sliding of the cores (C) towards the rewinder: actually, movements 5C and 6C are combined even if in the drawings they are represented as separated movements for the sake of clarity.

In FIG. 6, where the constructive details of the individual machines (in particular, the constructive details of the rewinder, the second accumulator and the cutting-off machine) are not illustrated, it is shown the path of the logs (L) in the area between the rewinder (R) and the cutting-off machine (CM).

In particular, FIG. 6 shows, downstream of the transport unit (LT) that, as mentioned above, moves the log (L) along an advancing path comprising a lateral deviation: a first ascending vertical translation (1L) of logs (L) when entering the second accumulator (LS); a second descending vertical movement (2L) of logs (L) in a stage prior to their exit from the second accumulator (LS); a third horizontal translation (3L) of the logs (L) when exiting from the second accumulator (LS); a fourth horizontal translation (4L), orthogonal to the third (3L), of the logs in a step of advancing towards the blade of the cutting-off machine (CM). In FIG. 6 the rolls produced by the cutting of the log (L) by means of the cutting-off machine (CM) are denoted by reference "RO". Inside the second accumulator (LS), the logs (L) are supported by shaped bars that move along a trajectory consisting of a succession of vertical and horizontal sections. In its terminal part (part facing the cutting-off machine), the second accumulator (LS), that can be of the known type comprising a series of log-supporting bars (PL) moved by chains, extends horizontally above the channels (CT) on which the logs normally slide when entering the cutting-off machine. Between the log-supporting bars (PL) and the channels (CT) are interposed corresponding so-called preload channels (CC) that receive the logs from the log-supporting bars of the accumulator (LS) and discharge them onto the channels (CT) of the cutting-off machine in synchronism with the pushers acting on the logs in the cutting-off machine according to a process known per se.

The transport unit for the logs (LT) that makes the logs to deviate laterally while they advance towards the cutting-off machine (CM) allows to make use of conventional machines for making the plant and, at the same time, allows the positioning of the cutting-off machine (CM) and the tube-forming (T) within the outline of the production line arranged upstream and comprising the rewinder (R), the embossing-sizing unit (EG) and the unwinding unit (UP).

The transport unit for the logs (LT) consists, for example, of three motor-driven loop chains constituted by meshes (MC) joined together by ball joints (SM), contained in guides (GC) having the desired orientation and equipped, at regular intervals, with blades (PC) that in operation are destined to be in contact with the back of the logs.

In practice, the transport unit (LT) forms a flow diverter for the logs (L), in the sense that it makes possible possible to divert the flow of logs exiting from the rewinder and place the cutting-off machine (CM) with its feeding channels (CT) also in an offset position with respect to the rewinder.

As shown in the drawings, the tube-forming machine (T) is located within the outline of the production line formed by the unwinders, the embossing-sizing unit and the rewinder.

Compared to a conventional plant, in which the tube-forming machine (T) is external to the production line formed by the unwinders, the embossing-sizing unit and the rewinder, there is a considerable saving of ground area in manufacturing the logs production plant. For example, for equal maximum size of the logs (logs length equal to 2850.00 mm) and hence the same machines used, in a traditional system the dimension "A" previously mentioned assumes a value of about 20 meters. By contrast, as mentioned earlier, positioning the tube (T) as in the diagram of FIG. 1, that is, by placing the tube-forming machine (T) such that it is intercepted by the direction (PP) that represents the path of the paper (W) from the unwinders to the rewinder, the dimension "A" has a value almost halved.

It is understood that, where the accumulation of the logs (L) upstream of the cutting-off machine (CM) is not required, the transport unit (LT) directly connects the rewinder (R) with the cutting-off machine (CM).

The tube-forming machine (T) can be placed downstream of the rewinder and upstream of the cutting-off machine, or upstream of the rewinder.

In practice the details of execution may vary according to what regards to the individual elements described and illustrated, without thereby departing from the scope of the adopted solution idea and, thereby, remaining within the limits of the protection granted by this patent.

The invention claimed is:

1. A process for the production of paper rolls, the process comprising:

a step of producing logs of paper material by winding a predetermined amount of paper web about a respective longitudinal axis;

a step of transverse cutting of the logs to obtain rolls of predetermined length; and an intermediate step of transporting the logs from a rewinder that produces the logs toward a cutting-off machine that cuts the logs transversely, said intermediate transporting step comprising the handling of the logs along a path comprising a lateral deviation, so that, as the logs advance, the logs are subjected to said lateral deviation.

2. A process according to claim 1, wherein said logs have an inner core formed by a cardboard tube.

3. A process according to claim 2, wherein said path comprises a part that passes beneath a tube-forming machine which produces the cores.

4. A process according to claim 2, wherein said path comprises a part that passes over a tube-forming machine which produces the cores.

5. A process according to claim 1, wherein, seen in plan view, said path comprises a S-shaped part.

6. A process according to claim 1, wherein said path comprises a part that passes beneath a tube-forming machine which produces cores for the logs.

7. A process according to claim 1, wherein said path comprises a part that passes over a tube-forming machine which produces cores for the logs.

8. A process according to claim 1, further comprising a step of accumulation of the logs in an accumulator for logs before entry of the logs into the cutting-off machine, so that said path is comprised between the rewinder and the accumulator of the logs and the accumulator supplies the cutting-off machine.

9. A process according to claim 1, wherein cores for the logs are produced at a point located downstream of the rewinder.

10. A plant for the production of rolls of paper, the plant comprising:

a rewinder that produces logs of paper material;

a cutting-off machine that cuts the logs transversely to obtain rolls of predefined length; and a transport unit arranged to move the logs from the rewinder toward the cutting-off machine, wherein said transport unit comprises an inlet section and an outlet section for the logs, said transport unit comprising a part between said input section and said output section adapted to impose a lateral deviation to the logs while the logs advance towards the outlet section, the output section of the transport unit being laterally offset by a predetermined value with respect to the input section.

11. A plant according to claim 10, wherein, seen in plan view, said transport unit log comprises a S-shaped part.

12. A plant according to claim 11, wherein said logs transport unit comprises a part that passes beneath a tube-forming machine which produces cores for the logs.

13. A plant according to claim 11, wherein said logs transport unit comprises a part that passes over a tube-forming machine which produces cores for the logs.

14. A plant according to claim 10, further comprising a tube-forming machine adapted to produce cardboard tubes each of which constitutes an internal core of a respective log.

15. A plant according to claim 14, wherein said logs transport unit comprises a part that passes beneath the tube-forming machine which produces the cores.

16. A plant according to claim 14, wherein said logs transport unit comprises a part that passes over the tube-forming machine which produces the cores.

17. A plant according to claim 10, further comprising an accumulator for logs upstream of the cutting-off machine, so that said logs transport unit is positioned between the rewinder and the accumulator for logs and the accumulator supplies the cutting-off machine.

18. A plant according to claim 10, wherein a tube-forming machine is located downstream of the rewinder with respect to the path followed by the paper web entering the rewinder.

19. A plant for the production of rolls of paper, the plant comprising:

a rewinder configured to produce logs of paper material, the rewinder comprising a rewinder center line;

a cutting-off machine configured to cut the logs transversely to obtain rolls of predefined length, the cutting-off machine facing opposite the rewinder along a direction of the rewinder center line; and a transport unit arranged to move the logs from the rewinder toward the cutting-off machine, wherein said transport unit comprises an inlet section and an outlet section for the logs, said transport unit comprising a part between said input section and said output section adapted to impose a lateral deviation to the logs while the logs advance towards the outlet section, the output section of the transport unit being laterally offset by a predetermined value with respect to the input section.

20. A plant according to claim 19, further comprising:

a tube-forming machine located downstream of the rewinder;

an accumulator for logs upstream of the cutting-off machine and downstream of the tube-forming machine, the logs transport unit being positioned between the rewinder and the accumulator for logs and the accumulator supplying the cutting-off machine, the part of the transport unit extending continuously from the tube-forming machine to the accumulator.

* * * * *